US006880221B2

(12) United States Patent
Sprenger

(10) Patent No.: US 6,880,221 B2
(45) Date of Patent: Apr. 19, 2005

(54) PURSE AND METHOD OF MAKING THE SAME

(76) Inventor: Nancy L. Sprenger, 4256 Lancelot Rd., Toledo, OH (US) 43623

( * ) Notice: Subject to any disclaimer, the term of this patent is extended or adjusted under 35 U.S.C. 154(b) by 119 days.

(21) Appl. No.: 10/116,406

(22) Filed: Apr. 3, 2002

(65) Prior Publication Data

US 2002/0157744 A1 Oct. 31, 2002

Related U.S. Application Data

(60) Provisional application No. 60/286,560, filed on Apr. 26, 2001.

(51) Int. Cl.[7] ..... A45C 1/02

(52) U.S. Cl. ..... 29/428; 150/107; 150/112; 150/119; 150/127; 150/128; 150/130; 493/244; 493/245

(58) Field of Search ..... 29/428; 150/107, 150/112, 119, 127, 128, 129, 130; 493/243, 244, 245, 260; 229/76, 77, 78.2

(56) References Cited

U.S. PATENT DOCUMENTS 2,175,327 A * 10/1939 Thornhill et al.
2,368,687 A * 2/1945 Stanley
2,437,534 A * 3/1948 Jackler
2,441,338 A * 5/1948 Stanley
2,442,091 A * 5/1948 Mann et al.
2,627,886 A * 2/1953 Barnes
2,769,193 A * 11/1956 Jackson
3,164,187 A * 1/1965 Simmons
3,186,461 A * 6/1965 Erickson
3,435,868 A 4/1969 Stermer
3,613,759 A 10/1971 Collings et al.
3,655,119 A 4/1972 Thompson
3,964,529 A 6/1976 Brod
4,011,898 A 3/1977 Hubbard
4,177,909 A 12/1979 Haskell
4,378,831 A 4/1983 Koltz
4,741,372 A 5/1988 Santilli
4,962,800 A 10/1990 Owiriwo
5,009,319 A 4/1991 Jantzen
D402,108 S 12/1998 Eddy
D403,151 S 12/1998 Heredos-Formby
D406,457 S 3/1999 De Baschmakoff
D406,458 S 3/1999 Liu
D415,893 S 11/1999 Inbert
6,017,072 A 1/2000 Grant
D419,764 S 2/2000 Kohlhase
D422,405 S 4/2000 du Sartel
D423,771 S 5/2000 Gomez et al.
6,065,515 A 5/2000 Harris
6,070,628 A 6/2000 Nastasi

* cited by examiner

*Primary Examiner*—David P. Bryant
*Assistant Examiner*—Eric Compton
(74) *Attorney, Agent, or Firm*—Fraser Martin Buchanan; Miller LLC; Donald R. Fraser

(57) ABSTRACT

A method of producing a purse or handbag from a single typically rectangular blank of flexible sheet material.

8 Claims, 4 Drawing Sheets

36

PURSE AND METHOD OF MAKING THE SAME

CROSS-REFERENCE TO RELATED APPLICATION

This application claims the benefit of U.S. provisional patent application Ser. No. 60/286,560, filed Apr. 26, 2001.

BACKGROUND OF THE INVENTION

1. Field of the Invention

The present invention relates to purses or handbags typically carried by women by hand or by a shoulder strap.

2. Description of the Prior Art

Purses and handbags are typically formed of flexible sheet material such as leather, synthetic plastic materials, or fabric formed of a large variety of natural and synthetic woven fibers. Shape retention is a major consideration in the design and production of such products. In certain instances the very nature of the sheet materials from which the products are made dictates the dimensional stability of the product. However, other materials, which tend to be softer and more pliable, require the use of stiffening materials such as a dimensionally stable facing material such as crinoline, for example.

SUMMARY OF THE INVENTION

It is an object of the invention to produce a purse or handbag which can be readily manufactured without the utilization of specially designed equipment.

Another object of the invention is to produce a purse or handbag which may be fabricated from a large variety of sheet materials.

Still another object of the invention is to produce a purse or handbag which is compact in size and may be stored and shipped in a space saving flat condition.

Another object of the invention is to produce a purse or handbag which may be readily, easily, and safely carried by the user.

The above objects, as well as others, may be typically achieved by a purse and method of making the same comprising the steps of:

providing a rectangular blank of flexible sheet material, the blank having spaced apart parallel side edges and spaced apart parallel end edges;

forming a first fold between a first panel and an adjacent second panel;

forming a second fold between the second panel and an adjacent third panel, the second fold being oppositely folded in respect of the first fold;

causing the first panel to fold against the second panel about the first fold;

causing the first and second panels to simultaneously fold against the third panel about the second fold;

forming a third fold between the third panel and an adjacent fourth panel, the third fold being oppositely folded in respect of the first fold;

causing the fourth panel to fold against the first panel and an exposed portion of the third panel;

stitching the side edges of the blank by causing the stitches to extend between the superposed third and fourth panels and through the superposed edges of the first and second panels;

separating the outer free edges of the first and fourth panels and forcing the third fold between the free edges of the first and third panels to a completely extended position;

forming a fourth fold in the third and the fourth panels; and causing the third and fourth panels to fold about the fourth fold to cause the folded portion of the third panel to lie in superposed relation of the first panel.

BRIEF DESCRIPTION OF THE DRAWINGS

Other objects and advantages will become manifest to those skilled in the art from considering the following detailed description of an embodiment of the invention in the light of the accompanying drawings in which.

DETAILED DESCRIPTION OF A PREFERRED EMBODIMENT OF THE INVENTION

Figure 3:
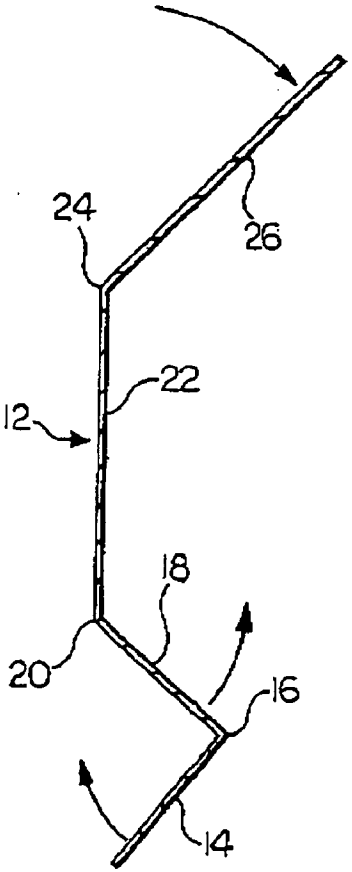
FIG. 3 is a side view similar to FIG. 2 illustrating the initial folds in the blank in the production of a purse.
Figure 2:
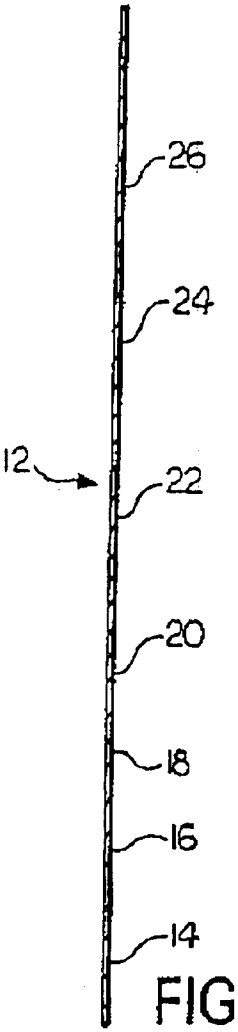
FIG. 2 is a side view of the blank illustrated in FIG. 1.
Figure 1:
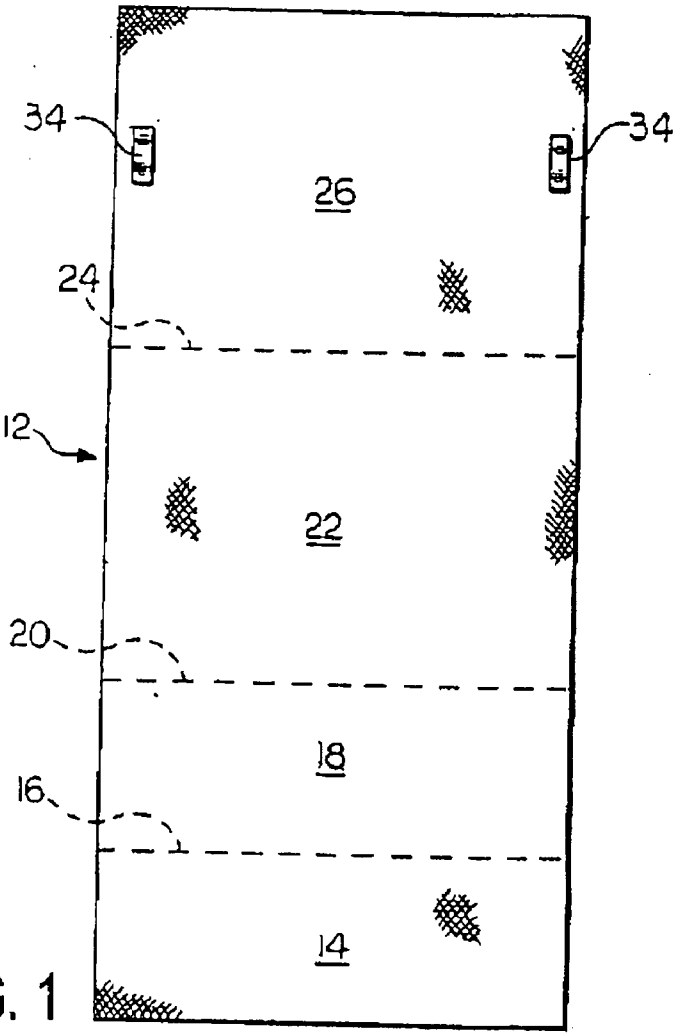
FIG. 1 is a plan view of the continuous blank of flexible sheet material from which a purse is to be produced embodying the features of the invention.
Figure 7:
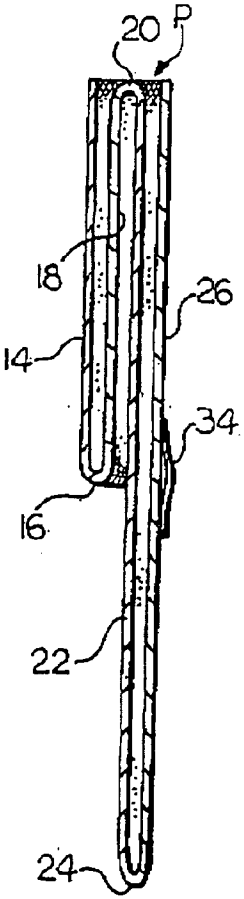
FIG. 7 is a side view of the stitched blank showing the fully inverted form.
Figure 6:
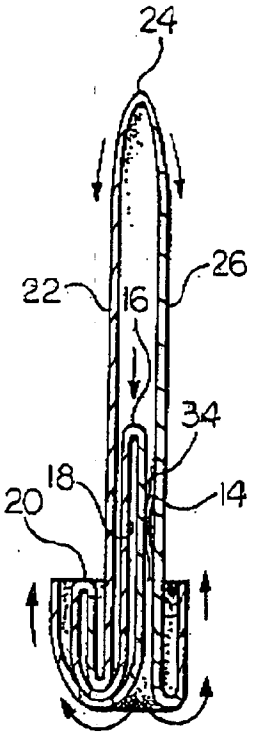
FIG. 6 is a side view in section of the blank after the side edges have been stitched together showing commencement of the inversion of the stitched blank.
Figure 5:
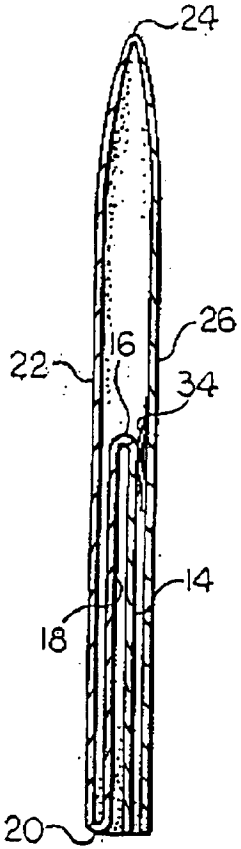
FIG. 5 is a side view of the blank illustrated in FIGS. 1, 2, 3, and 4 wherein the blank has been prepared for the stitching of the edges of the blank.

Referring to the drawings, there is illustrated a purse or handbag, generally indicated by reference numeral 10 formed of a blank 12 of flexible sheet material.

The blank 12 may be formed of a woven fabric, for example. The blank 12 is comprised of a plurality of serially arranged panels 14, 18, 22, and 26, joined by respective folds 16, 20, and 24, as will be explained in greater detail hereinafter.

Figure 4:
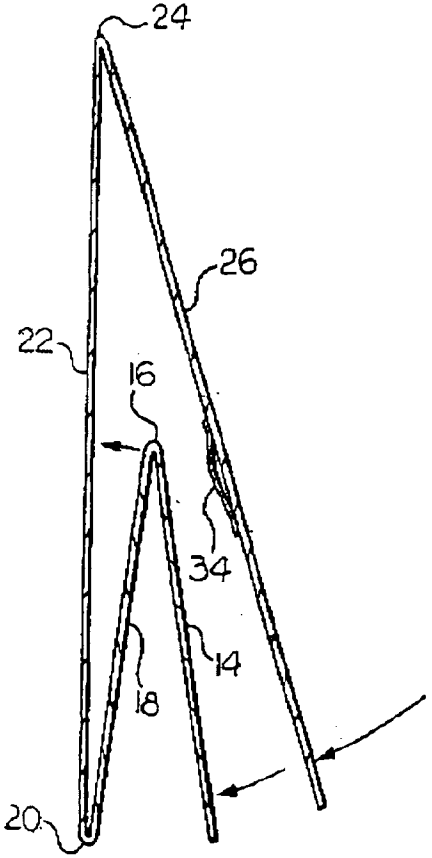
FIG. 4 is a side view of the blank illustrating the step following the step illustrated in FIG. 3 in the method of producing the purse.
Figure 9:
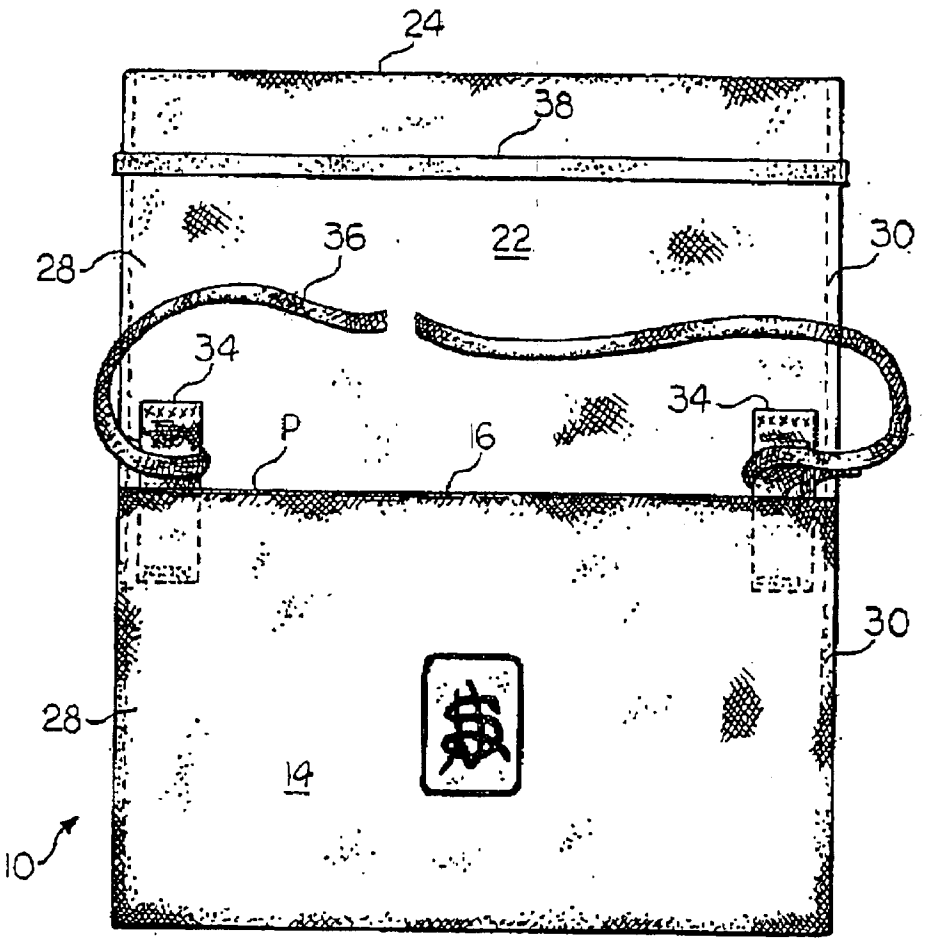
FIG. 9 is a front view of the purse illustrated in FIG. 8.
Figure 8:
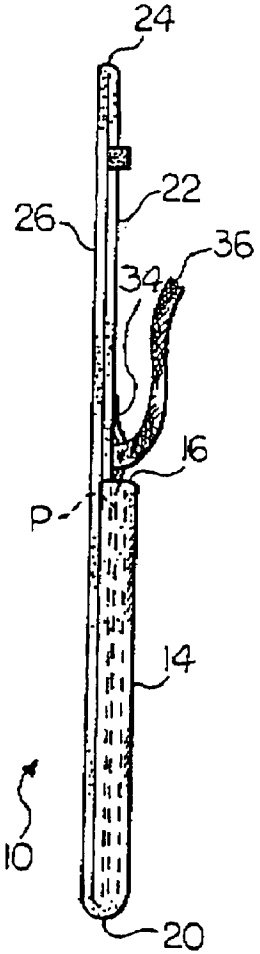
FIG. 8 is a side view of the completed purse in an open condition showing the attachment of a shoulder strap.

The purse 10 is typically formed by initially causing the panel 14 to be folded at the fold 16 onto the panel 18 as illustrated in FIG. 3 wherein the arrows indicate the folding directions. Next, the superposed panels 14 and 18 are folded about the fold 20 and laid upon the facing surface of the portion of the panel 22 adjacent the fold 20 as specifically illustrated in FIG. 4. Then the pane 26 is folded about the fold 24 causing the lower portion to be superposed on the panel 14 and the upper portion on the upper portion of the panel 22.

At this point in the production of the purse 10, the side edges of the folded blank 12 are typically stitched along lines 28 and 30 to close the internal spaces and create a pocket P defined by the facing surfaces of the panel 14 and the panel 22.

Finally, the portion of the purse defined by the superposed surfaces of the panels 22 and 26 above the fold 16 is folded along fold 32 to form a closure for the pocket P.

The structure of the purse 10 is complete.

It will be understood that should it be desired to utilize a shoulder strap to carry the purse 10, there is provided a pair of spaced apart loops 34 suitably secured to the inner face of the panel 26 generally equidistant from the free end edge and the fold 24. The loops 34 may be secured in any suitable manner such as by stitching. The loops 34 are provided to receive the ends of a carrying shoulder strap 36.

Figure 11:
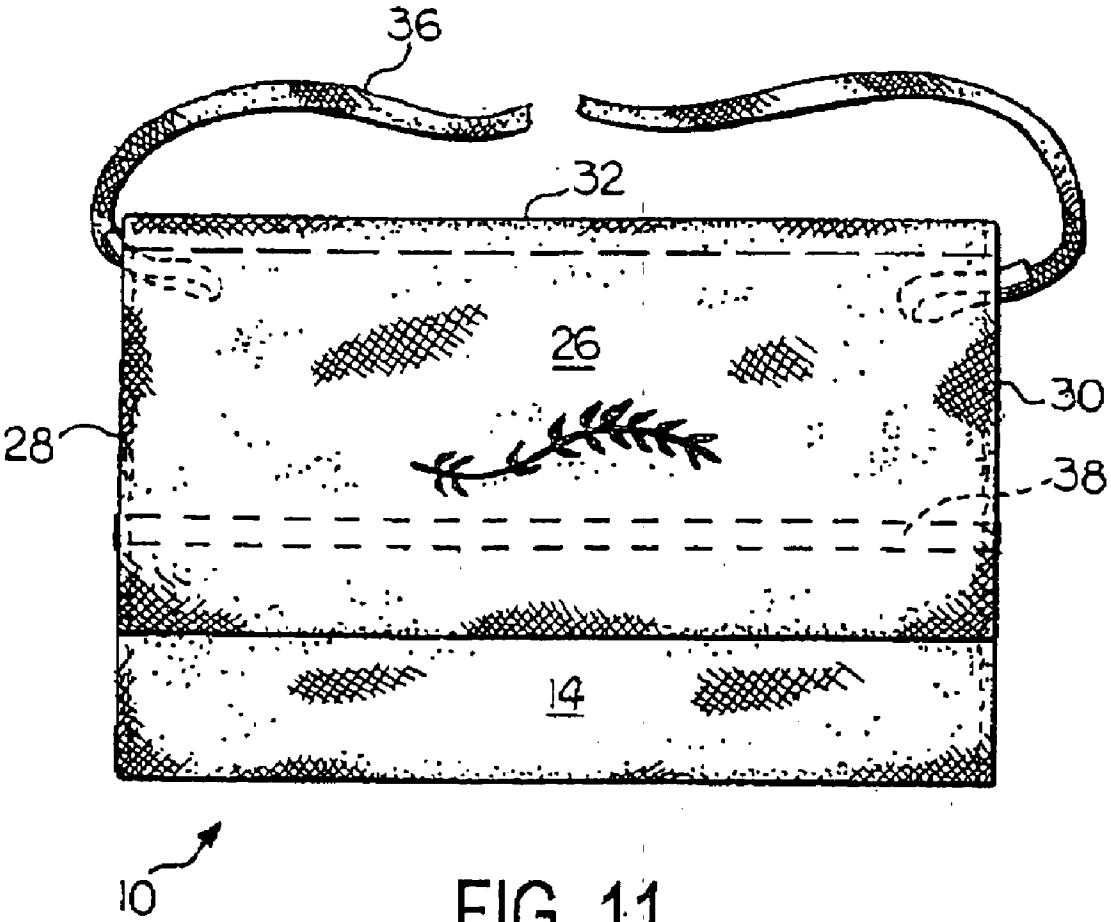
FIG. 11 is a front view of the purse illustrated in FIG. 10.
Figure 10:
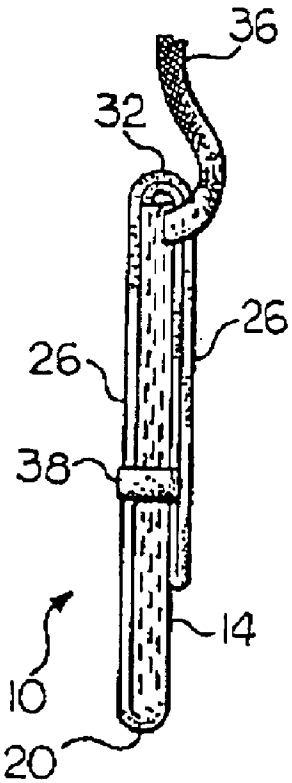
FIG. 10 is a side view of the purse illustrated in FIGS. 8 and 9 showing the purse in a closed position with the closure strap holding the cover in a closed position.

To secure the closure of the purse 10, a closure strap 38 may be provided and shown in an operative position in FIGS. 10 and 11.

While mention has been made of forming the blank 12 of a woven fabric, it will be understood that other flexible sheet materials may be used. Such other materials include leather and synthetic plastic sheet material. In the event the flexible sheet material requires additional reinforcement to facilitate dimensional stability, a rectangular blank of cardboard or the like can be used and inserted between the facing surfaces of the panels 14 and 18, for example. The insertion of the reinforcing material should be accomplished prior to the moment the side edges of the panels are affixed together.

In accordance with the provisions of the patent statutes, the present invention has been described in what is considered to represent its preferred embodiment.

However, it should be understood that the invention can be practiced otherwise than as specifically illustrated and described without departing from its spirit or scope.

What is claimed is:

1. A method of making a purse comprising the steps of:

providing a rectangular blank of flexible sheet material, said blank having spaced apart parallel side edges and spaced apart parallel end edges;

forming a first fold between a first panel and an adjacent second panel;

forming a second fold between said second panel and an adjacent third panel, said second fold being oppositely folded in respect of said first fold;

causing said first panel to fold against said second panel about said first fold;

causing said first and second panels to simultaneously fold against said third panel about said second fold;

forming a third fold between said third panel and an adjacent fourth panel, said third fold being oppositely in respect of said first fold;

causing said fourth panel to fold against said first panel and an exposed portion of said third panel;

stitching the side edges of said blank by causing stitches to extend between said superposed third and fourth panels and through the superposed edges of said first and second panels;

separating the outer free edges of said first and fourth panels and forcing said third fold between the free edges of said first and third panels to a completely extended position;

forming a fourth fold in said third and fourth panels; and causing said third and fourth panels to fold about said fourth fold to cause the folded portion of said third panel to lie in superposed relation to said first panel.

2. The method defined in claim 1 wherein said first fold is folded in a first direction.

3. The method defined in claim 2 wherein said second fold is folded in a second direction.

4. The method defined in claim 3 wherein said third fold is folded in a third direction which is the same direction as said first fold.

5. The method defined in claim 1 wherein said blank is provided with dimensionally stable backing material.

6. The method defined in claim 1 wherein said separating the outer free edges of said first and fourth panel and forcing said third fold between the free edges of said first and third panels to a completely extended position creates a pocket between the facing surfaces of the superposed portions of said second and third panels.

7. The method defined in claim 6 wherein said pocket has an open top and a closed bottom.

8. The method defined in claim 7 wherein the closed bottom of said pocket is defined by said second fold.

* * * * *